US006438774B1

(12) United States Patent
Michaelis et al.

(10) Patent No.: US 6,438,774 B1
(45) Date of Patent: Aug. 27, 2002

(54) CONVERTIBLE SLEEPING BAG

(75) Inventors: Susan L. Michaelis; Sarah R. McBride; Howard Hardee; Raymond Olson, all of Wichita, KS (US); Howard K. Peterson, Lake City, SC (US); Lauren D. Worley, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/577,254

(22) Filed: May 19, 2000

(Under 37 CFR 1.47)

(51) Int. Cl.[7] ..... A47G 9/08
(52) U.S. Cl. ..... 5/413 R; 2/69.5
(58) Field of Search ..... 5/413 R, 413 AM, 5/494; 2/69.5

(56) References Cited

U.S. PATENT DOCUMENTS 4,587,682 A 5/1986 Schultz
5,473,779 A * 12/1995 Kramer ..... 5/413 R
5,490,294 A * 2/1996 Kramer ..... 5/413 R
5,966,756 A 10/1999 Cartier
5,996,146 A 12/1999 McPherson
6,018,830 A * 2/2000 Howe ..... 5/413 R
6,073,282 A * 6/2000 Leeper et al. ..... 5/413 R
6,175,976 B1 * 1/2001 Cantwell ..... 5/413 R
6,216,290 B1 * 4/2001 Zemitis et al. ..... 5/413 R

* cited by examiner

*Primary Examiner*—Michael Trettel
(74) *Attorney, Agent, or Firm*—Kramer Levin Naftalis & Frankel LLP

(57) ABSTRACT

A sleeping bag allows users to adjust the bag between a conventional rectangular bag and a narrowed mummy-style bag, thereby adjusting the internal volume of the bag. This allows a user to reduce the inner air space of the bag forming a tapered mummy-style shape for maximum comfort in cold weather. The sleeping bag user may also expand the inner space of the bag into a non-tapered, substantially rectangular shape for maximum comfort and freedom of movement in warm weather. This adjustment may be accomplished quickly and easily via one or more secondary external zippers or a system of toggles and loops, allowing the sleeping bag user to respond to even sudden changes in temperature.

11 Claims, 7 Drawing Sheets

CONVERTIBLE SLEEPING BAG

FIELD OF THE INVENTION

The present invention relates to portable bedding, specifically to a sleeping bag allowing the user to adjust the bag between a conventional rectangular bag and a tapered mummy-style bag, thereby adjusting the internal volume of the bag.

BACKGROUND INFORMATION

Sleeping bags can be uncomfortable, and when they are uncomfortable, they can deny their users much-needed rest. Sleeping bag comfort is largely a matter of warmth—that is, providing the occupant with the correct amount of insulation to suit the existing conditions. Sleeping bag comfort is also a matter of providing the user with adequate freedom of movement. These two aspects of sleeping bag comfort can work against each other. For example, for similarly shaped bags, the more room there is inside a bag, the more freedom of movement is available to the occupant. However, the more room inside a bag, the more air space the user's body is required to heat and the more outer bag surface is exposed to the cold. Most sleeping bags provide comfort in only a rather narrow range of temperatures. Accordingly, sleeping bag manufacturers have long sought means of effectively adjusting the suitability of sleeping bags to fit a wider range of temperatures.

Accordingly, it is desired to provide a sleeping bag having increased warmth during cooler weather and increased freedom of movement during warmer weather, and to provide a more user-friendly, yet economical sleeping bag.

SUMMARY OF THE INVENTION

The present invention provides a sleeping bag that allows the user to adjust the sleeping bag between a conventional rectangular bag and a narrowed mummy-style bag, thereby adjusting the internal volume of the bag. The adjustable feature allows a user to reduce the inner air space of the bag to form a tapered mummy-style shape for maximum comfort in cold weather. The sleeping bag user also may expand the inner space of the bag into a non-tapered rectangular shape for maximum comfort and freedom of movement in warm weather. This adjustment may be accomplished quickly and easily via one or more secondary external zippers or other adjusting mechanisms, thereby allowing the sleeping bag user to respond to even sudden changes in temperature.

BRIEF DESCRIPTION OF THE DRAWINGS

FIG. 5A is a plan view of an alternate embodiment of a sleeping in its expanded rectangular warm weather position, while

DETAILED DESCRIPTION OF THE INVENTION

As shown in FIGS. 1, 3A, 3B and 3C a sleeping bag according to an exemplary embodiment of the present invention may have a pair of primary zippers 5 and a pair of secondary external zippers 10 attached to the outer shell of the sleeping bag. The primary zippers 5 are attached, for example, along each side or lateral edge of the sleeping bag and may extend along each side of the sleeping bag from the head end of the sleeping bag, terminating at or near the foot end of the bag. The secondary zippers 10 may begin, for example, at or near the midpoint of the length of the sleeping bag and may end, for example, at or near the foot or lower end of the bag. When the sleeping bag is in its expanded rectangular position, the sides of the zipper are closer together toward the head end of the sleeping bag than at the foot end. In other words, each set of the teeth of the zipper are not engaged in the expanded rectangular position and each set of teeth extend away from the other towards the lower end of the sleeping bag.

For example, as the secondary zipper 10 approaches the foot end of the sleeping bag, each set of teeth of the zipper angles away from the opposing set, increasing the distance between the two sets of teeth. In its expanded rectangular position, the two edges (e.g., sets of teeth) of the zipper are relatively close together at the head end of the zipper. The proximity of the edges of the zipper at the head end of the sleeping bag may be between, for example, one to eight inches, preferably two to six inches, and more preferably three to four inches. At its widest point, the zipper edges may be, for example, six to twenty inches apart, preferably eight to eighteen inches apart, and even more preferably ten to sixteen inches apart. Regardless of the distance between the zipper edges, the zippers are aligned in such a manner that a tapered mummy-style bag shape will result upon zipping the secondary external zippers.

Figure 1:
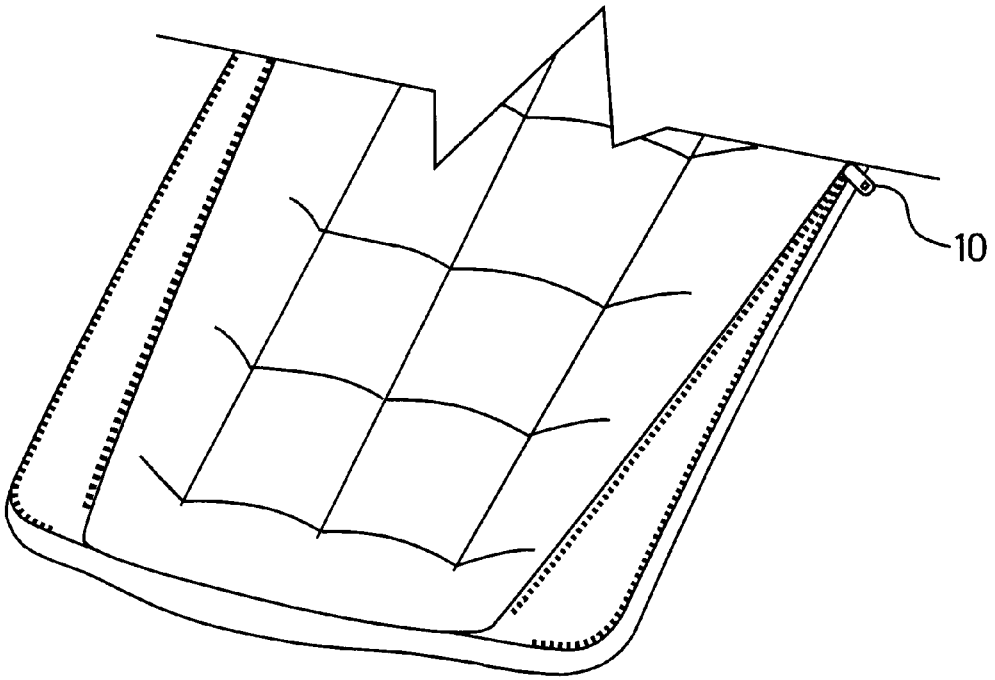
FIG. 1 is a perspective view of a sleeping bag in accordance with an exemplary embodiment of the present invention, showing the lower end of the bag in its expanded rectangular warm weather position.
Figure 2:
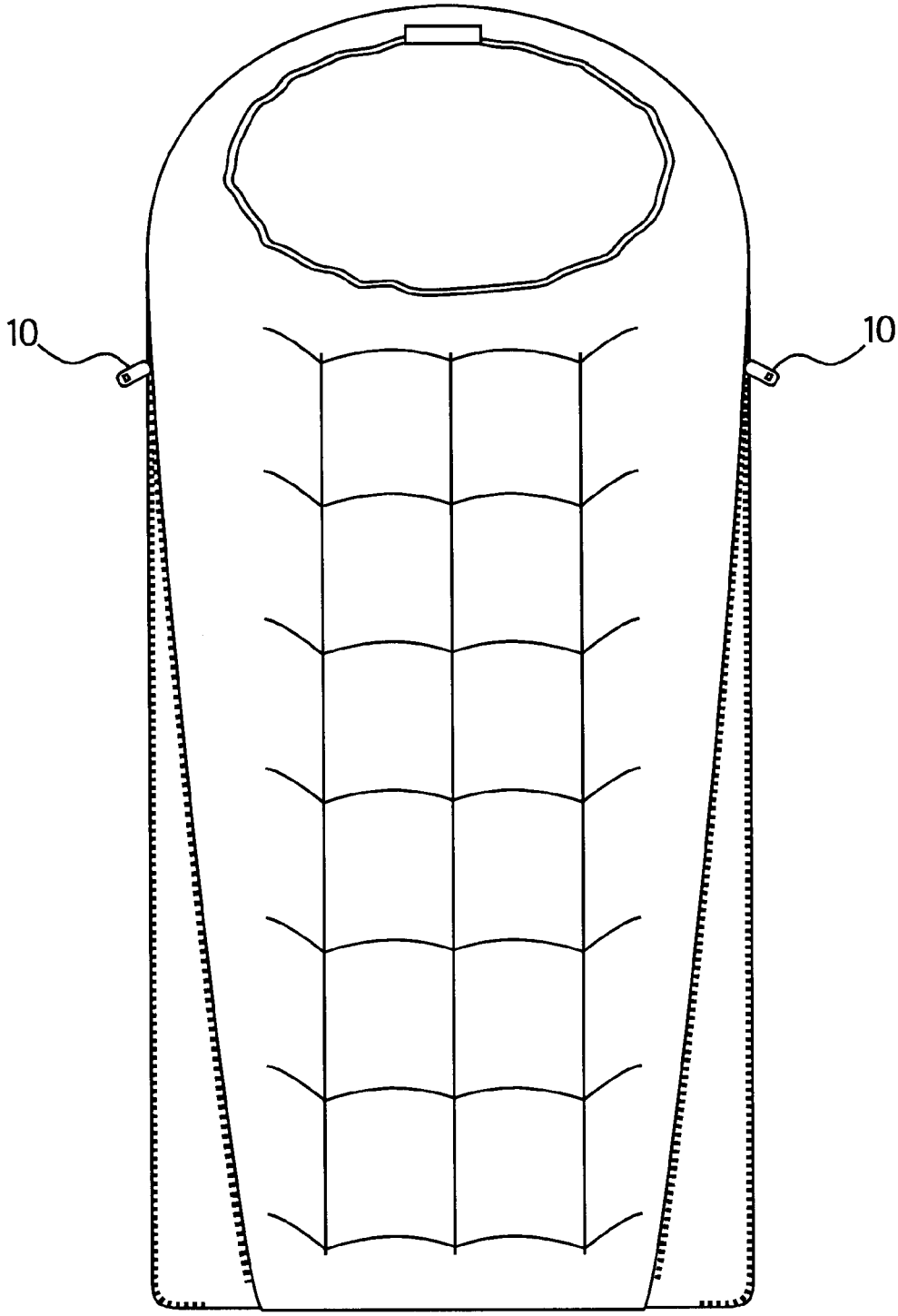
FIG. 2 is a plan view of a sleeping bag according to an exemplary embodiment of the present invention in its expanded rectangular warm weather position.

As shown by the plan view illustrated in FIG. 2, a sleeping bag according to an embodiment of the present invention will have, for example, a conventional rectangular shape when the secondary external zippers 10 are not fully engaged. This shape allows the user maximum freedom of movement of the lower extremities, and is the preferred shape for relatively warm temperatures.

Figure 3A:
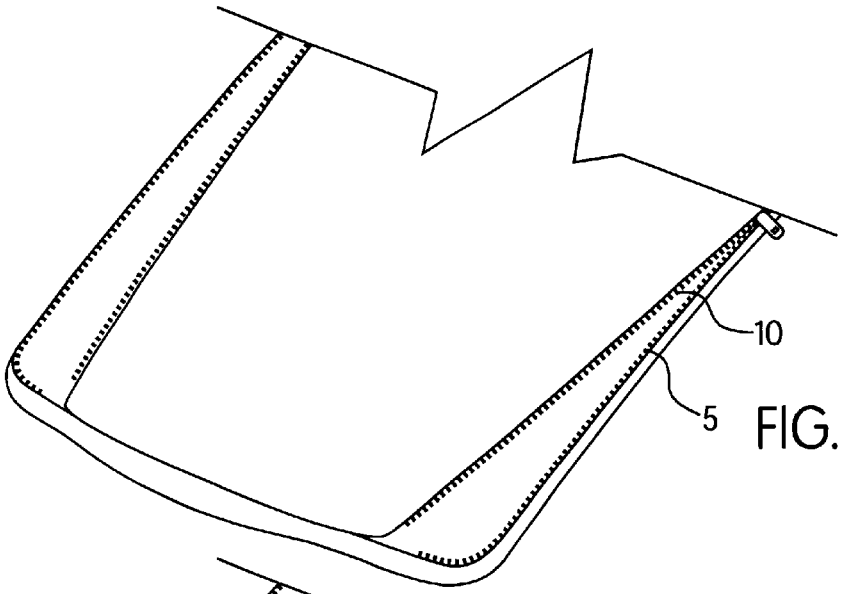
FIG. 3A is a perspective view of a sleeping bag according to an exemplary embodiment of the present invention in its expanded rectangular position.
Figure 3B:
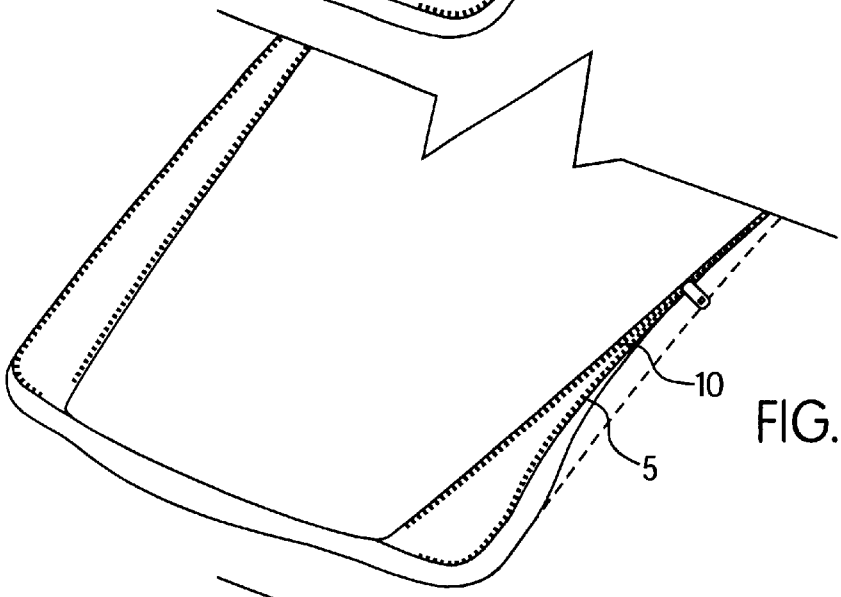
FIG. 3B is a perspective view of the sleeping bag of FIG. 3A, wherein the bag is between its fully rectangular and fully tapered position.
Figure 3C:
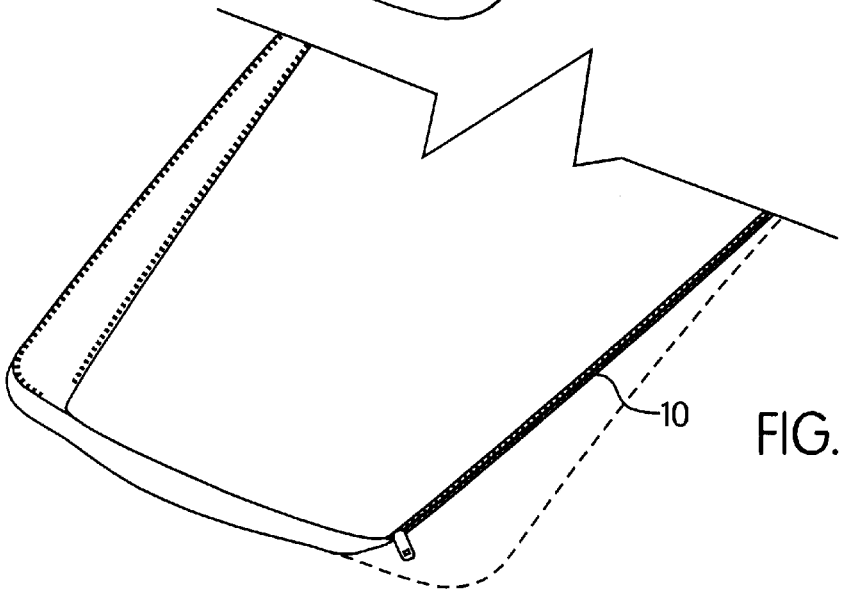
FIG. 3C in a perspective view of the sleeping bag of FIGS. 3A and 3B is its tapered cold weather position.

As shown in FIGS. 3A, 3B and 3C the external secondary zippers may be utilized to create a tapered mummy-style shape to the sleeping bag. The sleeping bag user simply engages the sets of teeth of the zipper and zips one or both of the external secondary zippers to create the mummy style shape.

Figure 4:
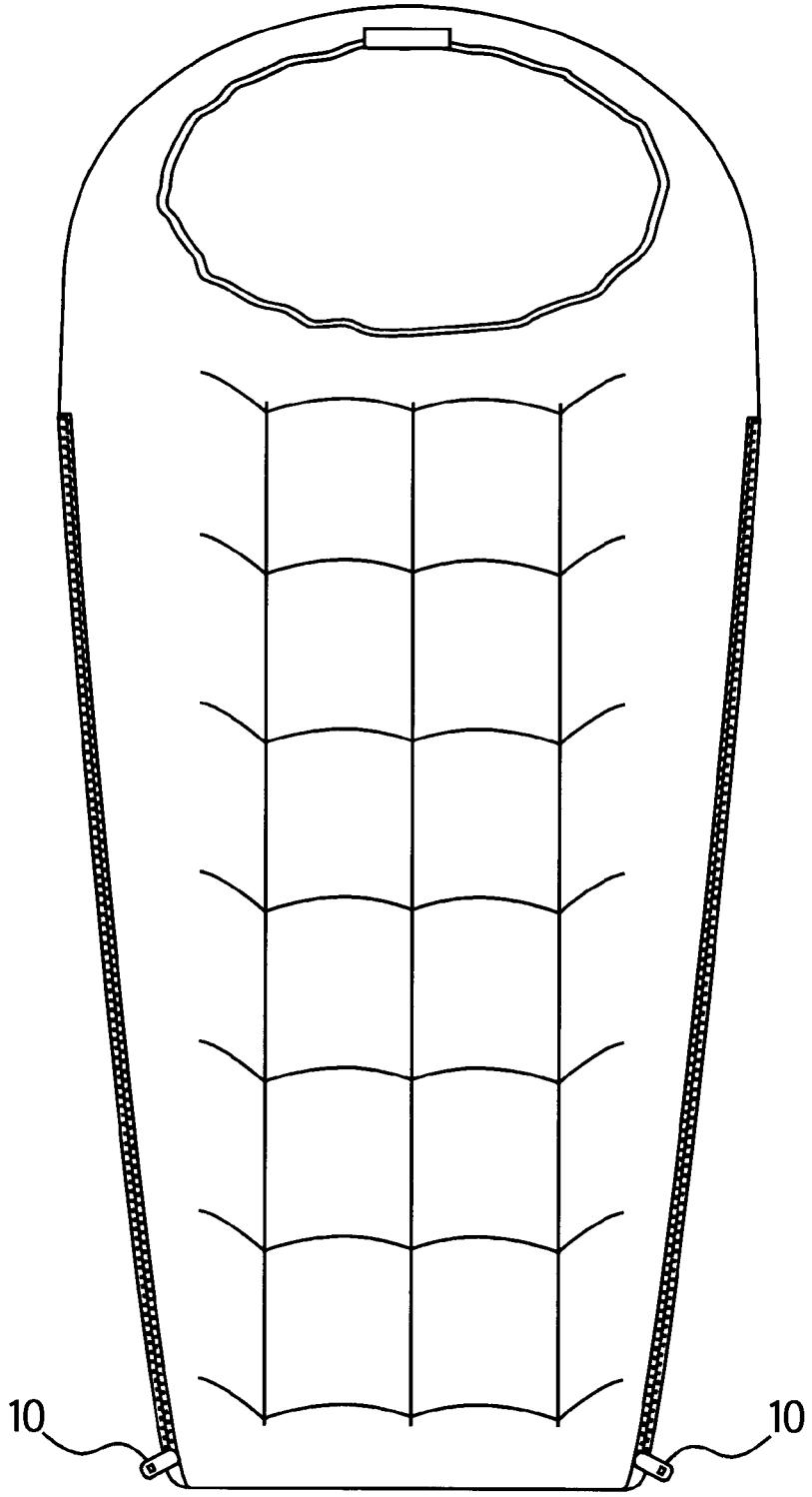
FIG. 4 is a plan view of a sleeping bag according to an exemplary embodiment of the present invention in its contracted and tapered cold weather position.

As shown by the plan view illustrated in FIG. 4, a sleeping bag according to an embodiment of the present invention will have a tapered mummy-style shape when the secondary external zippers 10 are zipped. This shape provides the user with maximum warmth and insulation and is particularly beneficial in colder conditions.

Figure 5A:
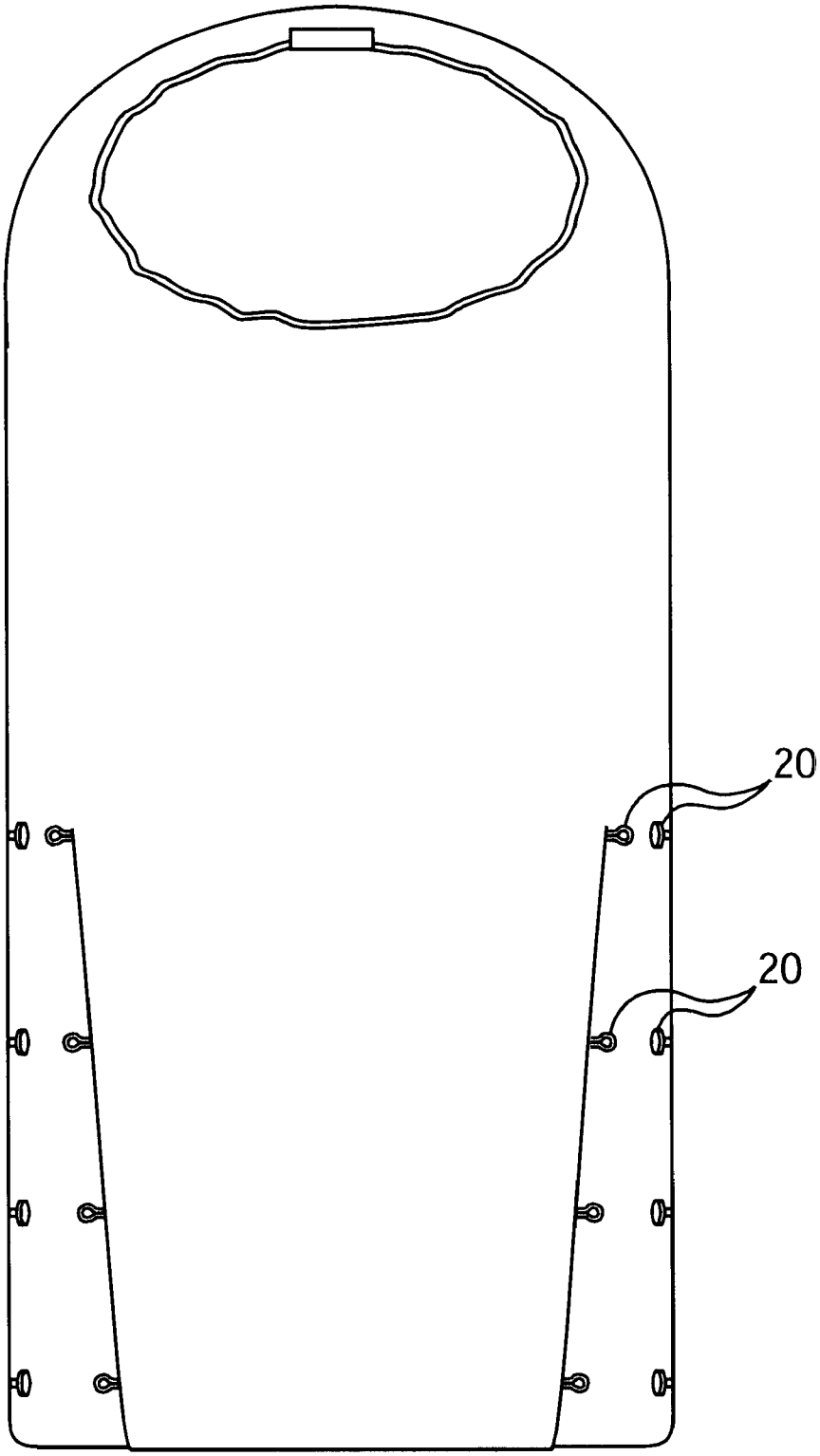
Figure 5B:
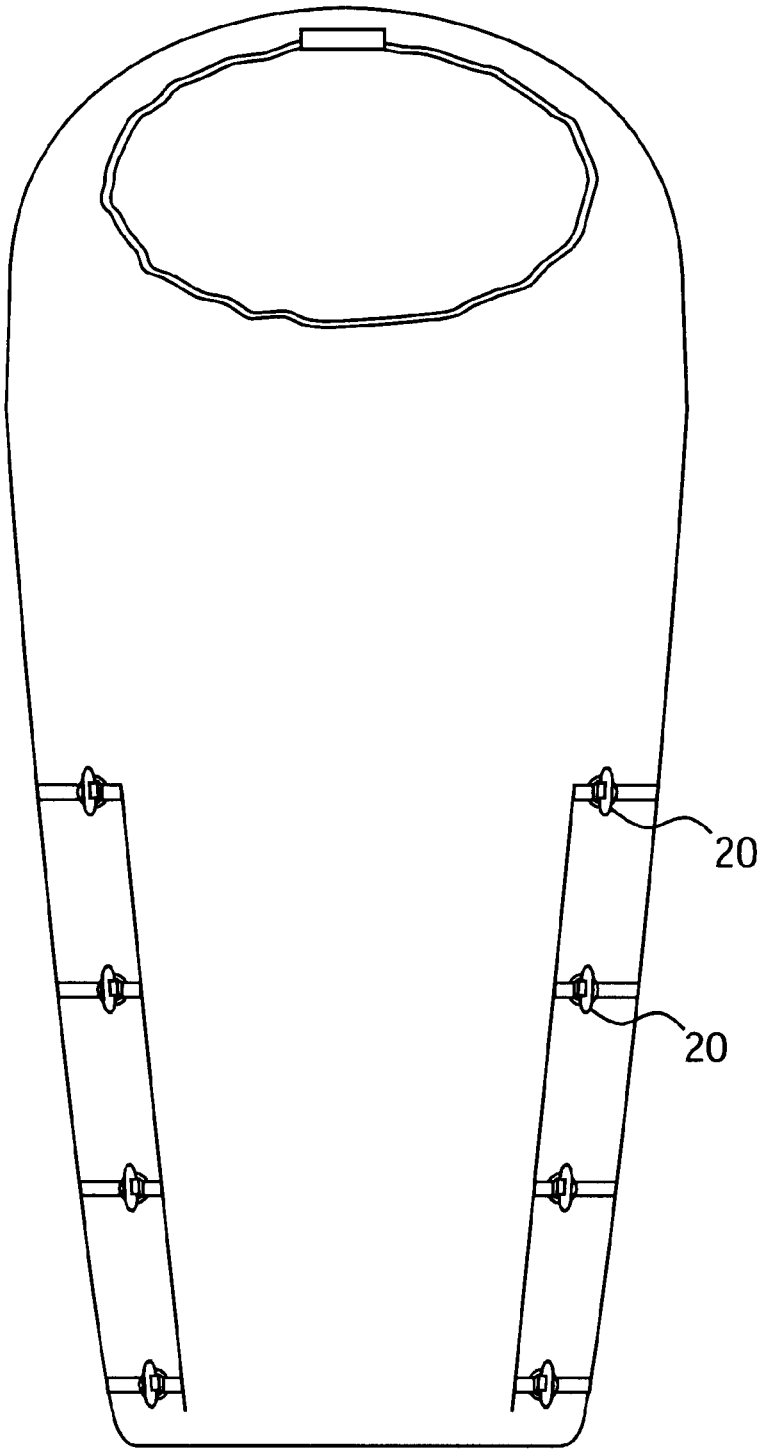
FIG. 5B is a plan view in the tapered cold weather position.
Figure 6A:
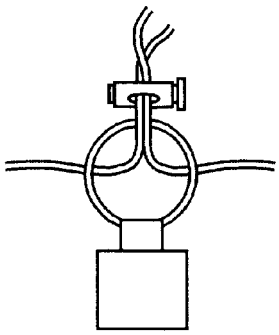
FIGS. 6A–E illustrate a variety of connecting mechanisms which may be used in accordance with exemplary embodiments of the present invention.
Figure 6B:
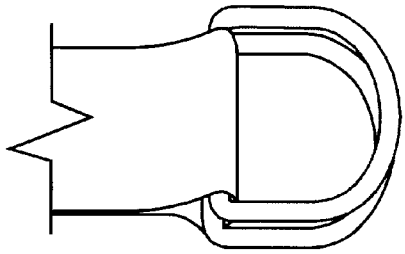
Figure 6C:
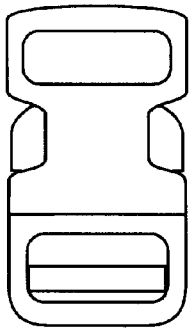
Figure 6D:
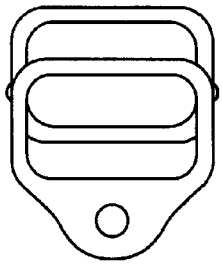
Figure 6E:
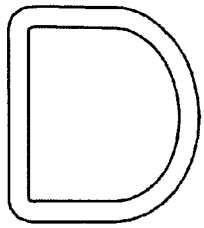

As shown in FIG. 5A and FIG. 5B an alternate embodiment of the present invention utilizes a toggle and loop 20 system instead of zippers 10. The toggle and loop 20 system is positioned on each side of the sleeping bag in a fashion similar to the zippers 10 described above. When the toggles and loops 20 are unconnected, the bag will have a rectangular shape suitable for relatively warm conditions. When the toggles and loops 20 are connected, the bag achieves a tapered mummy-style shape. In addition to secondary zippers 10 and toggle and loop connectors 20 as described above, other connecting devices may be used to switch the bag between tapered and non-tapered positions. For example, hook and loop fasteners, buttons, snaps, buckles, Velcro straps, cords or similar connectors may be used. Several types of buckles and connecting mechanisms are illustrated in FIGS. 6A–E.

Regardless of the type of connector, a sleeping bag according to an embodiment of the present invention may be changed from a rectangular to a tapered mummy-style shape. Since the connectors, such as zippers 10 or toggles and loops 20, are aligned, for example, along each side of the sleeping bag, each side may be independently controlled. Thus, the bag user, for example, may adjust the bag so that it is tapered only on one side. In addition, the degree of taper on each side may be adjusted, for example, by partially zipping the secondary zipper 10 on one or both sides. Likewise, other types of connectors may be partially connected to achieve variations in the extent and angle of taper. For example, if the bag incorporates a toggle and loop 20 system, the bag user can connect some but not all, of the toggle and loop 20 connectors on one or both sides of the sleeping bag. Likewise, if the bag incorporates, for example, a system of velcro straps, the length of such straps may be adjusted to provide variations in the extent and angle of tapers.

A sleeping bag according to an embodiment of the present invention can be produced simply and economically. The sleeping bag can be made with standard materials. A sleeping bag according to an embodiment of the present invention may be primarily for indoor or outdoor use, and may be insulated. An insulated sleeping bag may comprise two or more layers with insulation between these layers. The insulating material may be, for example, polyester fiber. Other insulating materials may include, for example, down. The insulating material may be quilted to one or both outer layers to hold the material in place throughout the life of the product.

As described above, a primary zipper 5 may be attached to the sleeping bag to allow the user access to the interior portion of the sleeping bag 10 and to allow closure of the bag 10 after use.

In operation, one uses the sleeping bag according to an embodiment of the present invention in a normal manner. For example, an insulating ground pad may be placed under the sleeping bag. In warmer conditions, the sleeping bag may be used in its conventional rectangular shape. When desired, the user can increase the warmth of the bag by, for example, zipping the external secondary zippers 10 to create a tapered mummystyle sleeping bag. In so doing, each corner at the foot end or lower end of the sleeping bag may be pushed inward to allow the external secondary zippers 10 to pass over corners. In other words, the bag user may achieve the tapered shape by pushing the triangular shaped lower corner of the sleeping bag toward the center of the bag so that the secondary zipper or other connecting device may by engaged. When the secondary zipper is closed, the triangular-shaped lower corner is contained within the secondary zipper and the tapered mummy-style bag is achieved. Likewise, if an alternative connecting device is used, the bag user may push the generally triangular shaped lower corner of the bag toward the center of the bag so that the alternative connecting device may be engaged. When the connecting device is engaged, the tapered mummy-style bag is achieved.

This tapered mummy-style bag provides greater warmth due to, for example, the decrease in air space within the bag. In addition, greater warmth is provided by the thickening of insulation due to the extra material that is entrapped within the area enclosed by the secondary zipper. This increase in thickness also makes the bag less susceptible to the user narrowing the insulation by body movement, e.g., by poking the insulation with a knee or foot. In addition, the surface area of outer shell fabric exposed to cold air is reduced.

When the user wishes to increase the inner volume of the bag to provide greater freedom of movement (and also result in some loss of insulating effect), it is only necessary to unzip the external secondary zipper 10, or other connecting device, on one or both sides and allow the bag to adopt its rectangular, non-tapered shape.

The operation of a toggle and loop system 20 as shown in FIGS. 5A and B works, for example, in a similar manner as described above for the zipper system. Likewise, the operation of other connecting devices works in a similar manner.

A sleeping bag according to an exemplary embodiment of the present invention can be produced economically, with greater versatility and increased comfort for both cooler and warmer weather. For example, the same sleeping bag now can be used in a greater variety of weather conditions, without the need to carry supplemental insulation. In addition, any type of sleeping bag can be adapted in accordance with the present invention to include external secondary zippers 10, a toggle and loop system 20, or other type of connector.

While the above description contains many specificities, these should not be construed as limitations on the scope of the invention, but as exemplifications of the presently preferred embodiments thereof. Many other ramifications and variations are possible within the teachings of the invention. For example, the starting and ending positions of the zipper 10 may be changed as well as the degree of taper. In addition, other types of connecting systems may be use in addition to or instead of zippers 10 and toggles and loops 20. Further, more than one of these types of connectors may be used on the same bag.

Thus, the scope of the invention should be determined by the appended claims and their legal equivalents, and not by the examples given.

What is claimed is:

1. A sleeping bag, comprising:

an upper sleeping compartment;

a lower sleeping compartment adjacent the upper sleeping compartment; and at least one secondary external connecting device coupled to the lower sleeping compartment, wherein the secondary external connecting device is capable of continuously variably converting the lower sleeping compartment between a first shape and a second shape;

wherein the upper sleeping compartment and the lower sleeping compartment are each formed from an inner fabric layer coupled to an outer fabric layer, an insulating material being disposed between the inner fabric layer and the outer fabric layer; and wherein the at least one secondary external connecting device includes a plurality of variable length fasteners spaced apart along each of a pair of opposed lateral side portions of the lower sleeping compartment, each of the fasteners comprising a pair of spaced apart fastener portions interconnected by an adjustable length connector extending transversely of the respective lateral side portions for continuously variably moving the opposed lateral side portions toward and away from one another adjacent to the lower sleeping compartment.

2. The sleeping bag of claim 1, wherein each of the plurality of variable length fasteners is connected to each opposing side of the outer fabric layer.

3. The sleeping bag of claim 1, wherein the first shape includes an extended warm weather position and the second shape including a closed cold weather position.

4. The sleeping bag of claim 1, wherein the adjustable length connector includes a hook and loop fastener strap.

5. The sleeping bag of claim 1, wherein the adjustable length connector includes a cord.

6. The sleeping bag of claim 1, wherein one of the fastener portions includes a buckle member.

7. The sleeping bag of claim 1, wherein one of the fastener portions includes a ring member.

8. A method of adjusting a sleeping bag for varied weather conditions, comprising:

providing a sleeping compartment having a pair of opposed lateral side portions, with at least one secondary external connecting device; and performing a continuously variable adjustment of the at least one secondary external connecting device between a first position and a second position;

wherein the at least one secondary connecting device includes a plurality of variable length fasteners spaced apart along each of the opposed lateral side portions, each of the fasteners comprising a pair of spaced apart fastener portions interconnected by an adjustable length connector extending transversely of the respective lateral side portions for continuously variably moving the opposed lateral side portions toward and away from one another.

9. The method of claim 8, wherein the variable length fasteners include a toggle and loop.

10. A method of adjusting a sleeping bag for varied weather conditions, comprising:

providing a sleeping compartment with at least one secondary external connecting device; and adjusting the at least one secondary external connecting device continuously variably between a first position and a second position, wherein the first position provides a more rectangular shape than the second position, and wherein the second position provides a more tapered shape than the first position;

wherein the at least one secondary connecting device includes a plurality of variable length fasteners spaced apart along each of opposed lateral side portions of the sleeping compartment, each of the fasteners comprising a pair of spaced apart fastener portions interconnected by an adjustable length connector extending transversely of the respective lateral side portions for continously variably moving the opposed lateral side portions toward and away from one another.

11. The method of claim 10, wherein the fasteners are adjusted to an intermediate shape between the first position and second position.

* * * * *